United States Patent [19]

Segerstrom

[11] Patent Number: 4,859,213

[45] Date of Patent: Aug. 22, 1989

[54] INTERCHANGEABLE QUENCH GAS INJECTION RING

[75] Inventor: Clifford C. Segerstrom, Houston, Tex.

[73] Assignee: Shell Oil Company, Houston, Tex.

[21] Appl. No.: 208,533

[22] Filed: Jun. 20, 1988

[51] Int. Cl.[4] ..... C10J 3/72; C10J 3/82

[52] U.S. Cl. ..... 48/87; 48/67; 239/567; 239/600; 422/207

[58] Field of Search ..... 48/87, 67, 61, 62 R, 48/77, DIG. 2; 261/118, 17, DIG. 54; 422/207; 110/215; 239/554, 555, 559, 567, 600; 196/140

[56] References Cited

U.S. PATENT DOCUMENTS 3,524,630 8/1970 Marion ..... 261/118

4,202,672 5/1980 Schuurman ..... 48/77

4,584,180 4/1986 Ostrov ..... 422/207

4,731,097 3/1988 Köhnen et al. ..... 48/87

*Primary Examiner*—Joye Woodard

*Attorney, Agent, or Firm*—Houston, TX 77252-2463

[57] ABSTRACT

An apparatus for injecting quench gas (cooled syngas) through an injection ring located around the circumference of the gasifier exit duct and having ports in communication with the interior of said duct to achieve thorough mixing of the gasifier gas with the injected quench gas. Interchangeable rings having different configurations and dimensions of the ports may be used to accomodate various types of coal. The rings may be fabricated in sections for ease of maintenance and replacement.

3 Claims, 4 Drawing Sheets

INTERCHANGEABLE QUENCH GAS INJECTION RING

BACKGROUND OF THE INVENTION

1. Field of the Invention

The invention relates to the process for the gasification of coal in suspension wherein the produce gas, called synthesis gas or syngas, is cooled by feeding back cleaned and cooled product gas into the product gas as it leaves the gasifier unit.

2. Prior Art

Processes for the gasification of coal in suspension have been known since the 1940's. In order to avoid the fouling of heat transfer surfaces of the waste heat boilers used in a conventional process for the gasification of coal, it is necessary to solidify the liquid slag droplets that are entrained in the gas leaving the gasifier, and to cool the liquid slag droplets to a temperature at which they are not sticky. This means that the entire gas stream leaving the gasifier must be cooled to a temperature that is about 100° F. (38° C.) below the slag softening temperature. For most coals the softening temperature of the ash is in the range of about 1900° F. to 2400° F. (1037° C. to 1316° C.). It is customary to operate the gasifier at a temperature of about 2700° F. (1482° C.) and to quench the hot gas just as it leaves the gasifier but before it enters the waste heat boiler.

As shown in the U.S. Pat. No. 3,963,457 to Hess, the Koppers-Totzek process (KTP) is recognized and understood by those skilled in the art to be a process for the gasification of coal in suspension. Previous gasifiers, such as the KTP, utilized spray water from the primary water pump into the stream of product gas just as it left the gasifier in order to cool the product gas and solidify the liquid slag droplets entrained therein. The use of spray water caused a large heat loss in the product gas however and, to eliminate this large heat loss, Hess improved the process by recycling cleaned and cooled product gas back into the product gas as it leaves the gasifier unit thereby cooling the product gas and eliminating the need for water sprays. This improved the thermal efficiency by a significant amount.

BRIEF SUMMARY OF THE INVENTION

The present invention improves upon the Hess process by providing a special injection ring having high velocity nozzles for injecting quency gas (recycled cooled and cleaned product gas) in a uniform but intense manner into the raw product gas as it exits the gasifier unit. The injection ring forms a protective annular layer of cool gas around the hot gas jet emanating from the reactor outlet duct thereby preventing hot sticky slag particles from contacting the quench pipe wall and thus eliminating slag accumulation. The injection ring is interchangeable with other injection rings, thereby facilitating the use of differing particulate coal solids in the gasifier. The specific design further provides for ease of replacement and maintenance of the injection ring.

DESCRIPTION OF THE PREFERRED EMBODIMENTS

In a typical coal gasification system employing the present invention, principal ingredients such as coal, steam and oxygen enter the gasifier wherein the coal is gasified. Most of the ash, in the form of slag, gravitates into a slag quench tank and thereafter is conveyed to a receiving bin and from this bin the solids are conveyed to a disposal site. The remainder of the ash is entrained in the product gas.

The hot product gases flowing from the gasifier are quenched, by an apparatus which is the subject of this invention, then enter a waste heat boiler from which high pressure saturated steam is withdrawn. The product gas leaves the waste heat boiler and flows into a primary venturi-type scrubber. Water discharges from the primary scrubber and flows thence to a clarifier. Product gas leaves the primary scrubber and flows into a secondary venturi-type scrubber. Product gas leaves the secondary scrubber and a portion thereof (cooled and cleaned) is returned through a recycle gas compressor to quench the stream of product gas just as it leaves the gasifier and solidify slag droplets entrained therein.

When the quench gas leaves the secondary venturi-type scrubber, it is clean and relatively cool. An alternate source of recycled gas is the gas leaving the waste heat boiler, or the gas leaving the primary venturi-type scrubber. Using recycled gas from these alternate sources, especially the waste heat boiler source, would further increase the thermal efficiency, but any solid matter in the gas could be troublesome to the operator of a plant.

Figure 1:
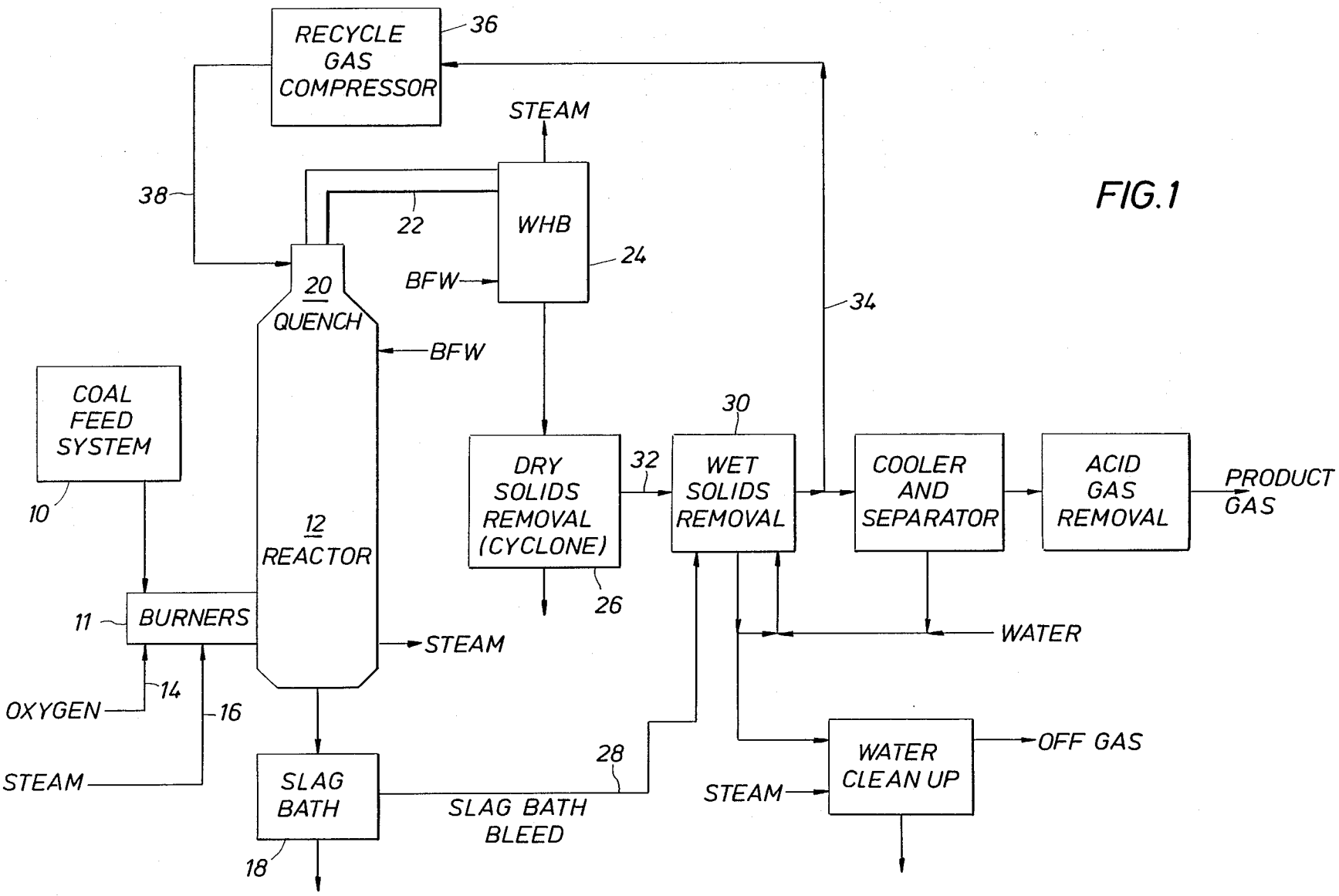
FIG. 1 is a simplified block diagram of a portion of the coal gasification system employing the invention.

Referring now to the drawings, FIG. 1 is a simplified block diagram of the pertinent portions of the coal gasification system utilizing the instant invention. Pulverized coal from the coal feed system 10 is fed into the burners 11 of the reactor 12 along with oxygen 14, including oxygen-enriched air, and/or steam 16. Ash, in the form of slag, gravitates into a slag bath tank 18 and thereafter is conveyed to a receiving bin for disposal. Product gas, containing entrained liquid slag droplets, rises in the reactor to the quench section 20, where the liquid slag droplets are solidified, and exits the reactor via duct 22 into the waste heat boiler (WHB) or syngas cooler 24. Solids in the form of fly ash gravitate to the dry solids removal section 26 such as a cyclone separator. The slag bath bleed 28 is fed into the wet solids removal section 30, along with the overhead gas 32 from the cyclone separator 26. A portion of cleaned and cooled gas 34 from the wet solids removal section 30 is then fed back, by means of recycle gas compressor 36, into the quench 20 of the reactor 12. The quench gas 38 entering the quench 20 cools the product gas such that entrained fly slag particles are solidified and will not stick to duct 22 or waste heat boiler surfaces 24 as the solids and gas pass through. The remainder of the product gas is further cleaned and cooled. The resultant slurry from the wet solids removal is directed to a water cleanup section prior to re-use or discharge.

Figure 2:
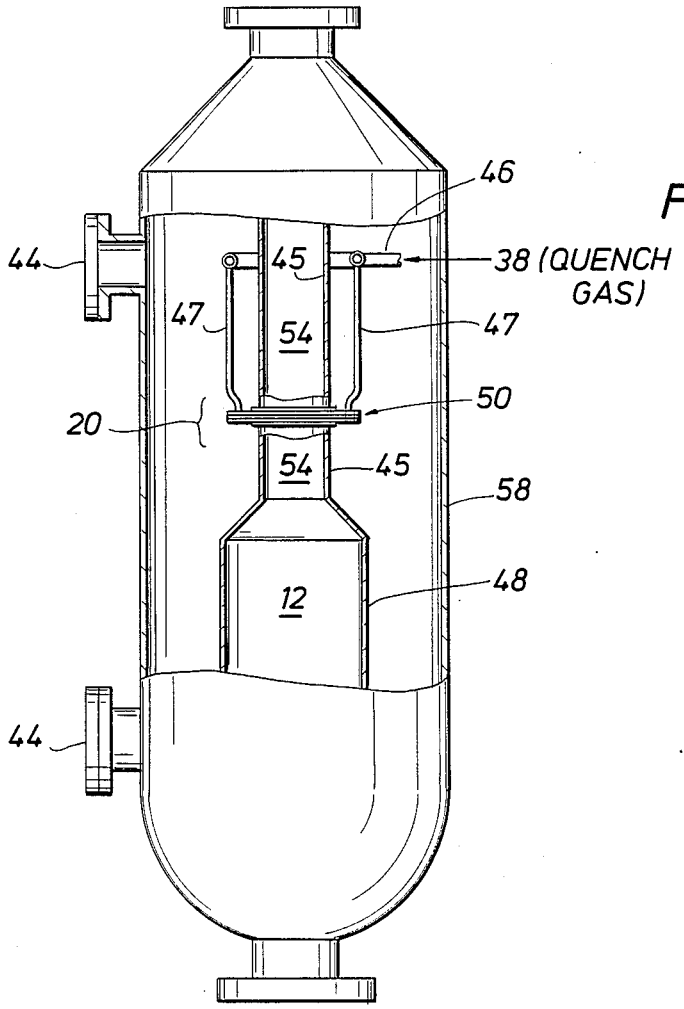
FIG. 2 is an elevation, partly in section, of the reactor/quench section.

Referring now also to FIG. 2, the function of the reactor or gasifier unit 12 is to provide an appropriate volume (residence time) and appropriate mixing conditions to gasify pulverized coal with oxygen and, if required, some steam. The three reactants—coal, oxygen and steam—are introduced into the reactor 12 through diametrically opposed burners 11. The reactor 12 is a cylindrical vessel with an outer pressure shell 58 and a water-cooled, refractory lined inner membrane wall 48 which is cooled by generating approximately 900 psia (62 BARA) saturated steam. The reactor 12 is a pressurized, entrained-bed gasifier operated under slagging conditions at pressures on the order of 365 psia (25 BARA) while the temperature is maintained high enough to melt the mineral matter in the coal.

The molten slag runs down the membrane wall 48 to the bottom of the reactor and exits through a slag tap into the slag bath 18. Raw syngas containing fly ash particles leaves the top of the reactor through duct 22. The diameter of the reactor 12 must be large enough to minimize the effects of flame impingement and excessive heat flux on the membrane wall 48, while the length of the reactor 12 must be large enough to provide sufficient residence time/breakthrough time for the desired carbon conversion to take place. On the other hand, too large a diameter or length would increase heat loss to the membrane wall 48 and thereby reduce the efficiency of the process.

The quench 20 is a critical item in a coal gasification process where the system is designed to operate successfully for any type and grade of coal and in which all of the quench fouling parameters are present, such as in the present system. Because so many phenomena interact, the quench problem is exceedingly complex. Fouling is influenced by aerodynamics, thermal and dynamic particle history, and adhesion of particles to the wall. The actual gasifier environment poses a critical test for new quenches. Sharp temperature transitions between the reactor outlet and the quench zone are required and fouling in the lower part of the quench must be prevented. Further, a large diameter allows more time for particles to cool prior to impaction on the walls. Fouling has been shown to relate strongly to coal conversion (reactor outlet temperature) and on coal type.

In the instant coal gasification system, cleaned and cooled product gas is recycled from the gas cleanup section 26, 30 to provide a quench for cooling the product gas. A compressor 36 is provided to pressurize the recycle gas for a range of expected quench conditions and coal types. Another condition for recycle gas requires the use of high velocity quench nozzles to provide intensive mixing during the quench.

The purpose of the quench 20 is to cool the reactor 12 exit gas (product gas) from approximately 2280°–2730° F. (1250°–1500° C.) down to a level such that the entrained fly slag particles will be sufficiently solidified and will not stick to the syngas cooler surfaces. High pressure saturated steam at approximately 1150–1500 psia is generated in the tubes of membrane wall 45. The quenched gas is cooled further in a duct 22, heat from the gas being transferred by radiation and convection to boiling water circulating in tubes (not shown) lining the duct.

The function of the syngas cooler or waste heat boiler 24 is to further cool the gas and to recover waste heat, as high pressure steam, as efficiently as possible. The cooler 24 is a water tube type exchanger and consists preferably of a superheater, evaporator and economizer (not shown).

The cooler 24 has a downflow configuration, i.e., gas will enter the cooler 24 from the duct 22 at the top and flow downward through the superheater, evaporator and economizer sections of the cooler 24. Gas leaving the economizer will enter a cyclone separator 26 located below the cooler. The exit temperature of the gas is influenced by the ammonium chloride ($NH_4Cl$) dewpoint. For Texas lignite coal, the $NH_4Cl$ dewpoint is estimated to be about 400° F. (204° C.). To prevent $NH_4Cl$ condensation, the gas exit temperature is premised to be on the order of 460° F. (238° C.).

Figure 2A:
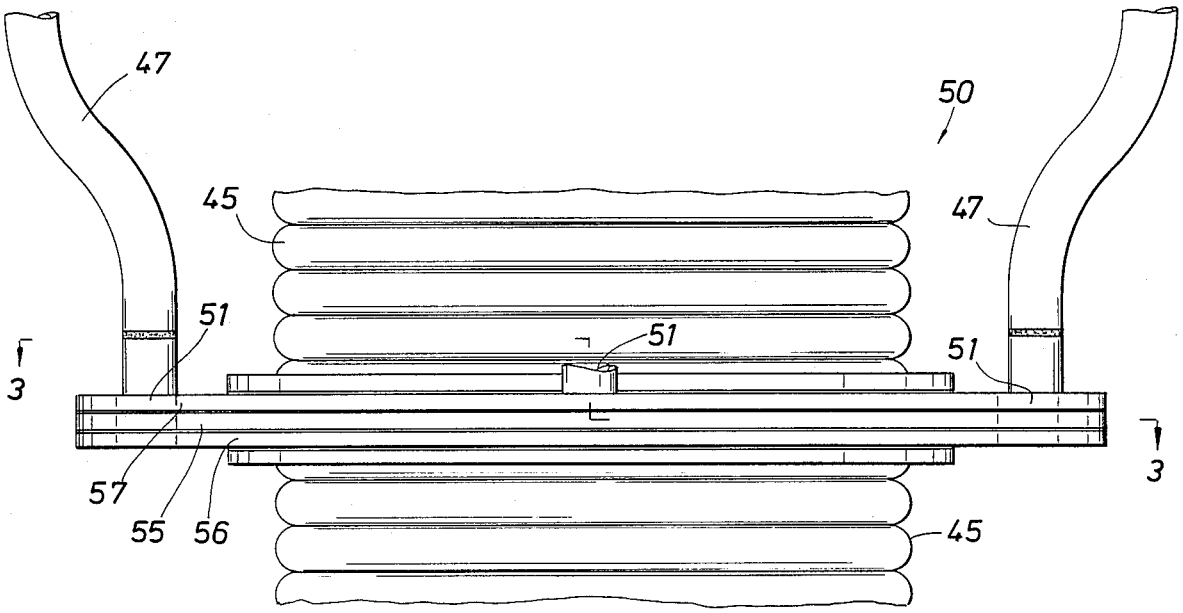
FIG. 2A is an enlarged elevation of the injection ring assembly.

Referring now to FIGS. 2 and 2A, the quench section 20 of the gasification system is shown with access manways 44 for servicing the section. This section is located at the outlet of the reactor 12 as previously described and a membrane wall 45 comprising cooling tubes provides cooling from reactor gases. A quench gas injection ring assembly shown generally at 50 provides a means for injecting cooling quench gas 38 by means of the quench gas inlet pipe 46 and inlet tubes 47. FIG. 2A is an enlarged drawing of the injection ring assembly 50.

Figure 3:
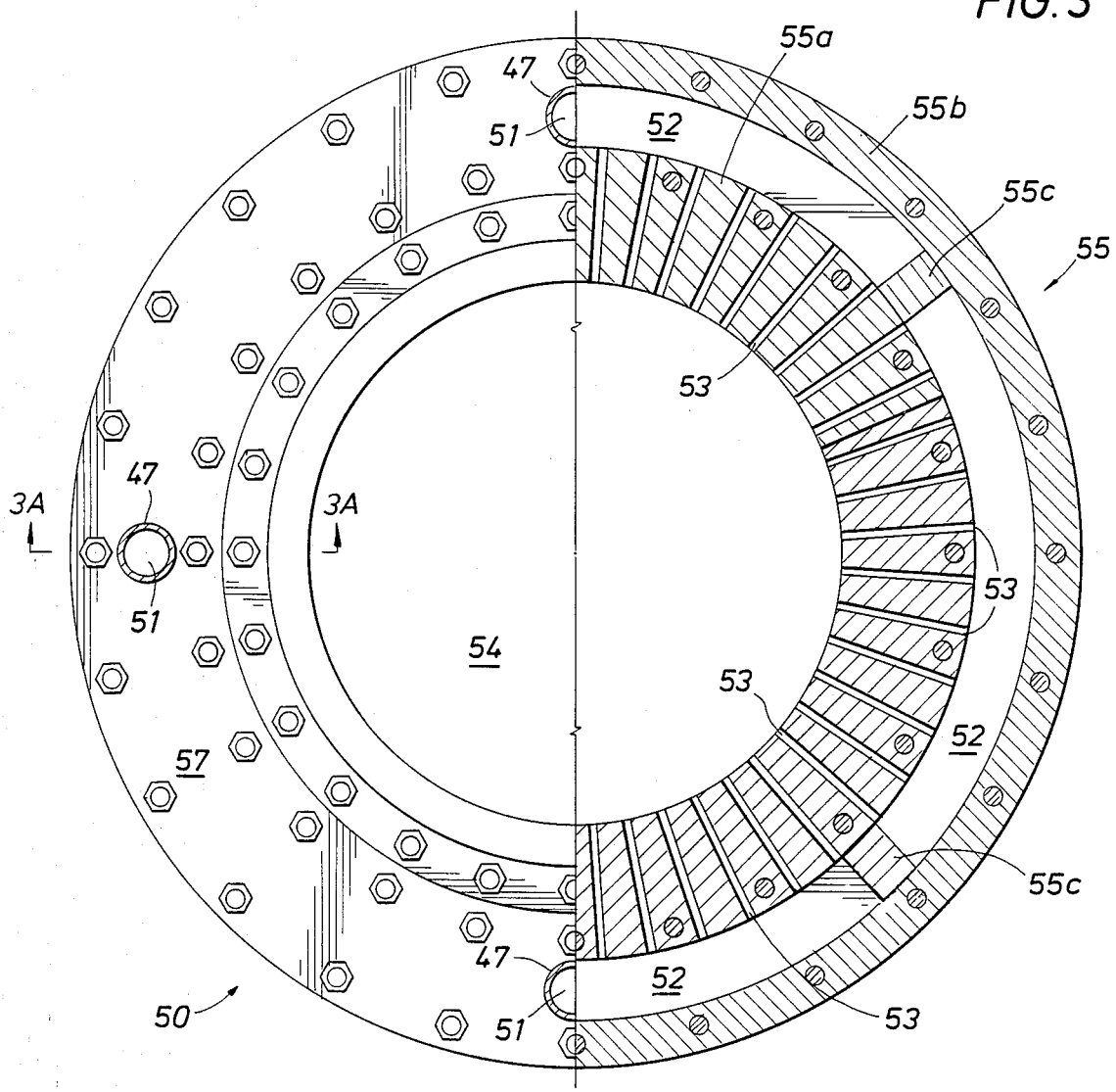
FIG. 3 is a drawing, partly in section, of the injection ring assembly of the invention taken along line 3—3 of FIG. 2A.
Figure 3A:
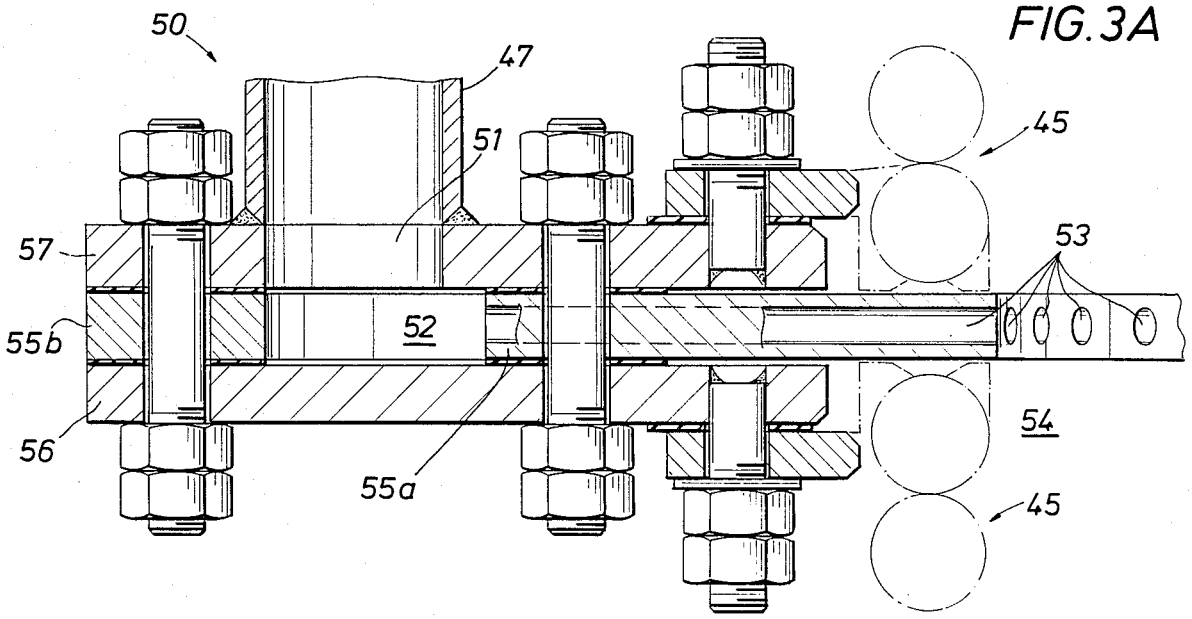
FIG. 3A is a cross section of the injection ring assembly taken along line 3A—3A of FIG. 3.

Referring now to FIGS. 3 and 3A, the quench gas injection ring assembly 50 is shown in partial section and includes an injection ring 55 sandwiched between a top plate 57 and a bottom plate 56. The quench gas inlet pipe 46 (FIG. 2) provides quench gas 38 to the inlet ports 51 via inlet tubes 47, each of which ports exits into a plenum chamber 52. Each plenum chamber 52 is in communication with a plurality of bores defining quench gas injection passageways 53, which terminate in the interior of the reactor outlet duct 54 and the product gas flowing therethrough. The inside diameter of the ring assembly 50, including membrane wall 45 to which top plate 57 and/or bottom plate 56 may be affixed is essentially the same as the inside diameter of the reactor outlet duct 54 so as to provide no obstruction to the product gas flowing therethrough. Quench gas 38 is injected into the product gas via plenum 52 and the passageways 53 in an intensive but uniform and controllable manner by means of this configuration. The injection passageways 53 are uniform for a specific injection ring 55, but the diameters may vary from 5 mm to approximately 25 mm for expected coal types of Illinois No. 5 and Texas lignite respectively and for variations in quench shaft diameter. Quench shaft diameter and the number and size of passageways 53 are set by each specific application, depending upon desired velocity of quench gas 38, to ensure thorough mixing and to prevent fouling of the passageways.

Figure 4:
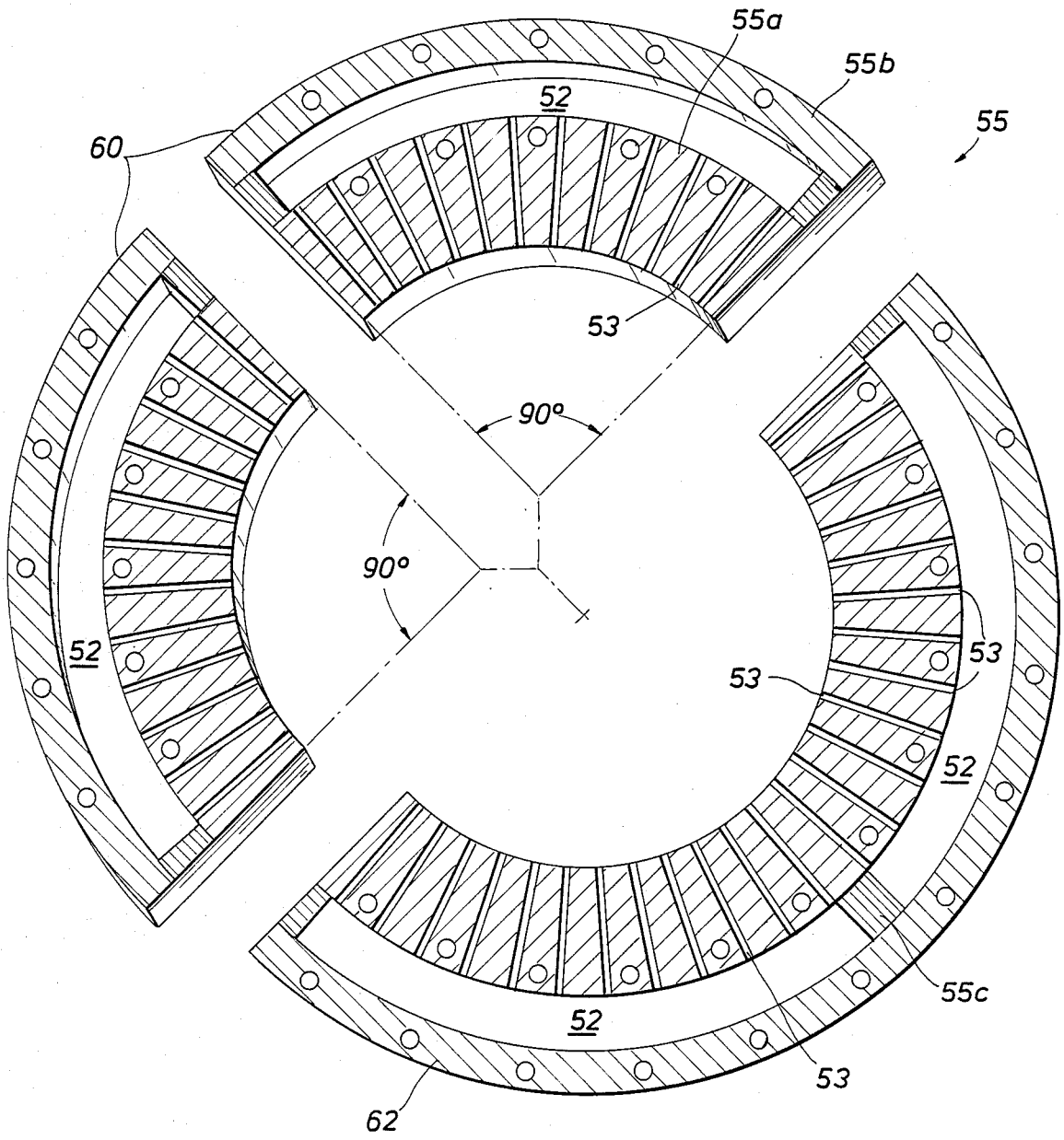
FIG. 4 is a preferred embodiment of the injection plate.

The quench ring assembly 50 is fabricated with a baseplate 56 and a top plate 57 (which includes the inlet ports 51) with the quench ring 55 sandwiched in between. The quench ring 55 is comprised of an inner portion **55*a* and an outer portion 55*b* with the two portions spaced from each other and held together by support webs 55*c* so as to form a space therebetween which, together with the top plate 57 and base plate 56, defines the plenum chamber 52. The assembly 50 is held in place by means of mounting bolts. The top plate 57 and base plate 56 comprise terminations of the gasifier outlet duct 54 (including membrane wall 45) thereby facilitating removal and replacement of the injection ring 55. In reactors 12 where the distance between the inside diameter of the pressure shell 58 and the injection ring 55 is greater than the diameter of the injection ring 55, the injection ring 55 may be fabricated in one piece. In other applications, where that distance is smaller, the injection ring 55 will require fabrication in smaller sections such as half, or even quarter sections as shown in FIG. 4. For example, the injection ring 55 may be fabricated in four pie-shaped sections 60 having arcs of 90° or two semi-circular sections 62. In this manner, the injection ring 55 may be removed and replaced a section at a time by removing the mounting bolts and sliding it out. This greatly facilitates maintenance and repair or for complete replacement where it is determined, for example, that larger (or smaller) injection passageways 53 are required under particular operating conditions. For replacement, the technician enters through the manway 44 and operates from scaffolding, for example, inside the reactor 12**.

Although the present invention has been described in connection with a particular coal gasification system, it will be apparent to those skilled in the art that the invention could be used in other applications, such as under differing temperature and pressure conditions, or in any process where hot process gases must be rapidly cooled by another gas and the process is carried out in a vessel with an internal water-cooled membrane wall. The invention could even be used in non-cooled reactors with thick refractory linings.

What is to be claimed:

1. An apparatus for injecting quench gas in a gasification reactor comprising:

an injection ring formed by least two arcuate sections, each of said sections having an outer arcuate portion and an inner arcuate portion spaced inwardly of and concentric with said outer portion thereby forming an arcuate space between said inner and said outer portions, and a plurality of bores defining passageways in said inner portion and extending radially therethrough;

a base plate and a top plate matingly secured to said sections and defining with said arcuate space a plenum chamber, said top plate having a fluid port therein in fluid communication with said plenum chamber; and means for injecting a quench gas into said fluid pot.

2. The apparatus of claim 1 wherein said at least two arcurate sections comprise two semi-circular sections.

3. The apparatus of claim 1 wherein said at least two arcurate sections comprises at least one section having an outer periphery defined by an arc of 90°.

* * * * *